United States Patent [19]

Dahmen et al.

[11] 4,136,417

[45] Jan. 30, 1979

[54] METHOD AND MACHINE FOR FORMING A HOLLOW RIVET

[75] Inventors: David L. Dahmen; Luis Zapata, both of Barranquilla, Colombia

[73] Assignee: Remaches Industriales S.A., Barranquilla, Colombia

[21] Appl. No.: 793,127

[22] Filed: May 2, 1977

[51] Int. Cl.[2] ..... B21K 1/60

[52] U.S. Cl. ..... 10/27 R; 10/27 E; 10/27 PH

[58] Field of Search ..... 10/11 R, 15, 24, 25, 10/27 E, 27 PH, 27 R

[56] References Cited

U.S. PATENT DOCUMENTS

| | | | |
|---|---|---|---|
| 107,160 | 9/1870 | Bruso | 10/25 |
| 666,092 | 1/1901 | Fox | 10/25 |
| 2,139,936 | 12/1938 | Clouse | 10/25 |
| 2,184,752 | 12/1939 | O'Brien | 10/12 T |
| 2,667,650 | 2/1954 | Friedman | 10/27 PH |
| 2,786,217 | 3/1957 | Johnson | 10/27 PH |
| 3,540,255 | 11/1970 | Hanna | 72/256 |
| 3,720,968 | 3/1973 | Garlaschi | 10/27 PH |
| 4,044,588 | 8/1977 | Haines | 10/11 T |

*Primary Examiner*—E. M. Combs

*Attorney, Agent, or Firm*—Barlow & Barlow

[57] ABSTRACT

The method and machine for forming a hollow rivet having a head at one end and an axially recessed shank at the other end, by means of placing a blank in a fixed die and performing the extruding operation on one end of the blank followed by a heading operation on the other end of the blank by a single blow of the heading hammer and then ejecting the hollow headed rivet from the fixed die.

14 Claims, 16 Drawing Figures

METHOD AND MACHINE FOR FORMING A HOLLOW RIVET

BACKGROUND OF THE INVENTION

In the past various methods and apparatus have been conceived to manufacture headed articles having tubular shanks, such as rivets, in a single die. Historically, extruded semi-tubular rivets were first produced in large scale in multiple die headers. There are inherent difficulties with the single die approach resulting from the fact that metal flow is required at two locations, namely the extrusion at one end of a sheared blank to form the tubular shank and upsetting at the other end of the sheared blank to form the rivet head. Elaborate mechanisms have been required up to the present in order to promote a constant volume of metal flowing into the extruded tubular shank as distinguished from the upset head. Otherwise there will be unacceptable variations in shank length and head dimensions from rivet to rivet under production conditions. In many known cases, representing the majority of semi-tubular rivet capacity actually in use, these mechanisms have been added to the type of machines generally referred to in the art as single die double blow headers.

A double blow header in general terms includes a die block through which stock is fed by intermittently driven food rollers to a timed shearing mechanism whereby a blank is sheared off, transfer mechanism whereby the blank is positioned in front of a forming die, and a header slide carrying forming tools whereby the blank is given two heading blows before the next shearing cycle takes place. The header slide is reciprocated in the usual manner and usually includes two heading tools mounted on a shifting mechanism which alternately presents the tools to the blank. In a double blow header, the arrangement is such that the header slide makes two strokes to one stroke of the shear and transfer mechanism thereby providing the so-called double blow arrangement.

Machines of the double blow type were originally developed for the production of headed blanks where the material to be upset thereby forming the head corresponds to an amount difficult to upset and control evenly if the forging or upset action is not divided between a first and second blow. This generally considered to be the case when the volume of material required to form the head corresponds to a length of blank 2.5 times or longer than the diameter of the cylindrical blank. The great majority of small cold heated screw blanks fall into this category where two blows are required and it is in the area of screw blank production that the two blow header finds nearly universal application. However, the great majority of headed articles having a tubular shank, which in this application is called semi-tubular rivets even though the invention is useful for the production of other tubular or polygonal barreled hollow upset parts in addition to semi-tubular rivets properly called, have a head with less than the volume of material requiring two blows for good upsetting practice. This is to say that the head of semi-tubular rivets can generally be formed quite effectively in a single blow. In the case of single die double stroke tubular headers described in the prior art, one of the two blows performs the function of forming the sheared blank in such a way as to establish the proportion of material flowing into the extruded shank as opposed to the head and other blow completes the operation. In many of the prior structures (U.S. Pat. No. 3,720,968 and U.S. Pat. No. 3,200,424) the first blow performs the extrusion operation and the second blow performs the upsetting operation. Thus it can be appreciated that in these two methods which are currently widespread and important in the industry, the cold heading machine is essentially operating as a single blow header insofar as the head upsetting operation is concerned.

One of the most expensive mechanisms of two blow headers is that which shifts the heading tools in order to present them alternately to the blank during each machine cycle. It is also the mechanism which tends to wear out first during the useful life of the machine and hence its use entails a substantial ongoing maintenance expense as well as great skill on the part of the operators which adjust it.

Typically double blow cold header configurations for the production of semi-tubular rivets such as those covered in U.S. Pat. Nos. 3,200,423; 3,200,424 and 3,720,968 rely upon the motion of the heading slide in order to provide the motion which effects the extrusion of the tubular shank. These mechanisms all suffer from the great drawback that the tool which contacts the blank and over which the material extrudes, and which will be referred to as the extrusion pin, inevitably is driven with its greatest velocity at the instant of initial contact, and its velocity relative to that of the mass of the sheared blank decreases as the extrusion proceeds. This is exactly the inverse of the ideal situation, and the high shock loading on the extrusion pin at the moment of initial contact is a major factor in limiting the maximum production speed which is practical for cold headers of this type. At high speed the extrusion pin tends to be deflected off center, and under production condition cases occur when it will actually collapse under compressive stress.

Claims have been made (U.S. Pat. No. 3,540,255) for forming hollow metal articles in a single fixed die with a single blow. However in these claims the extrusion operation takes place when the heading punch is closed against the die thus confining the upset blank in such a way that the shank material will flow back over the extrusion pin when advanced against the shank. This previously disclosed technique has the disadvantage that a heading blow delivered by a punch mounted on a slide driven by a crank shaft and pitman arm permits only a very restricted portion of the machine cycle to be dedicated to the forward movement of the extrusion pin. This is because the header punch remains closed only instantaneously during the machine cycle, and any attempt to drive the extrusion pin forward and continue extruding once the heading punch begins to move away from the heading die following the forward dead center position results in the shank bulging under the head which is at the junction of the straight shank and upset portion of the piece. This is unacceptable and must be avoided. In an ordinary single blow design the extrusion motion can be initiated effectively by advancing the extrusion pin at a point in the machine cycle slightly before the forward dead center position of the heading punch and the motion can be continued until just passing the forward dead center position. During this short interval the portion of the shank being formed by the header punch is contained either by the punch form or what amounts to a "friction hill" which resists further flow of the upset material between the closely spaced parallel or nearly parallel surfaces of the header die and header punch. Hence during this short interval the pressure generated by the extrusion operation is unlikely to cause large variations in the amount of material formed in the upset portion of the work piece corresponding to the head. Subject to the above mentioned restriction the hollow shank length of the article produced will not vary excessively.

Unfortunately this simple mechanical expedient places a severe limitation on the maximum production rate which can be achieved. The maximum accelerations of the extrusion pin must be limited and this limits the cycle speed when driving the extrusion pin by a rocker arm movement driven from the header slide. In an attempt to reduce the impact load on the extrusion pin a cam driven motion is often provided for the extrusion pin. Since cams fail if required to deliver a stroke in too short an interval of time, this approach also severely limits the machine cycle times which can be attained.

SUMMARY OF THE INVENTION

A strip of stock of the required cross section is fed into a carrier which moves laterally of the strip of stock to cut off a blank of the required length and continues to place this blank in front of a fixed die and then into the fixed die, the carrier then retreating so that a portion of the carrier provides an anvil against which the blank may be forced by an extruding pin which places an axially extending recess in the blank. Thereafter the anvil further retreats to remove the anvil and open the die. The blank is forced out of the fixed die a certain distance sufficient so that the material which protrudes beyond the die may provide enough volume for a head on the end of the blank. The extruded blank is then backed up and a head is struck on the protruding portion of the blank and thereafter the heading tool retreats and a sleeve about the extruding tool forces the rivet in completed form from the fixed die. The operation is all done in sequence of steps operated largely by cams so as to control the timing of action of the different parts.

This invention embodies separate mechanisms for extruding the tubular portion of the shank which in no way derive their movement from that of the heading slide. In this way the expense of a punch shifting mechanism is eliminated and more important the speed and production rate of the cold header can be essentially doubled for a given level of machine sophistication and construction expense.

This invention provides a mechanism whereby the extrusion pin is brought into contact gently, is accellerated at a controlled rate, and in general its displacement as a function of time is a function of rational design parameters. This approach facilitates the production of hole depth to hole diameter ratios in the extruded portion of the shank which are greater than normal, more concentric holes can be produced and longer extrusion pin life results. These are all important factors under production conditions. In the case of the present invention, it should be emphasized that it is novel in that no element driven by the heading slide, works the blank during the operation of extruding the tubular portion of the shank.

The present invention eliminates the limitation of machine speed due to interrelation of extrusion and forming the head by completely divorcing the extrusion operation from the upsetting operation. A laterally introduced blocking mechanism traps the sheared blank in the fixed heading die at which time the extrusion pin is advanced by a cam mechanism. The heading die is fixed. Once it is blocked by a laterally introduced rigid element it is perfectly feasible to dedicate a reasonably long portion of the machine cycle to advancing the extrusion pin. As a result it is possible to use remarkably fast machine cycle speeds and still not place undue stress on the mechanical elements. Tooling life and extrusion mechanism part life is increased in spite of the higher machine speeds.

Furthermore the extrusion of the tubular shank takes place with the sheared blank trapped completely in the fixed die against the laterally introduced blocking element. There is no possibility of material intended to be extruded into the tubular portion of the shank being forced instead into the upset portion corresponding to the head. The net result is to insure greater uniformity of head size and shank length than has ever been possible with the ordinary single die single blow approach.

Once the extrusion of the tubular shank has been performed, novel mechanisms have been provided to ease the blank out of the fixed die a distance sufficient so that the material which protrudes beyond the die may provide enough volume for striking a head on the end of the blank. These mechanisms must provide for easing the blank variable distances in order to be able to produce rivets of varying head sizes, and they must do so with gradual acceleration so as to permit the relatively fragile extrusion and knockout pins to perform their function at high machine speeds without undue breakage. This objective is achieved whereby the cam which urges the extrusion pin forward dwells upon completing the extrusion function, thereby maintaining the elements driving the extrusion pin in a state of compression. Once the anvil which blocks the mouth of the fixed die retreats, a second small and gentle raise is provided on the cam driving the extrusion pin. In this way the axially extruded blank is urged into initial movement in a gentle way involving no shocks since the extrusion pin drive train is precompressed. Due to the phenomena of stick-slip friction with respect to the axially extruded blank being expanded in the fixed die, the first 1/32nd of an inch of travel of the blank out of the die represents the greatest loading on the extrusion pin. Once this initial resistance is overcome, a second cam comes into action in a synchronized manner with the second raise on the first extrusion cam in order to continue to urge the moving extrusion pin forward a variable distance and at an increased speed consistent with the decreased resistance encountered by the extrusion pin after the initial 1/32nd of an inch of movement.

Actually four cams are provided for achieving the desired combination of movements of the extrusion pin and knockout bushing. This is in order to be able to position the knockout bushing in such a way as to provide for squaring the end corresponding to the butt or axially extruded end during the single heading blow. Then again a combination of two cams is used in order to urge the knockout bushing forward which displaces the headed and completed workpiece from the die. One cam provides a gentle initial movement through a mechanism which has been precompressed during the heading blow, and once the blank which is again expanded in the fixed die during the heading blow begins to be urged out of the fixed die due to the gentle raise of the first cam providing great mechanical advantage, a second cam brings an additional mechanism into action which picks up the motion initiated by the first cam and urges the knockout bushing further forward an adjustable distance and at greater velocity.

DESCRIPTION OF THE PREFERRED EMBODIMENT

Blank Formation and Travel

Figure 1:
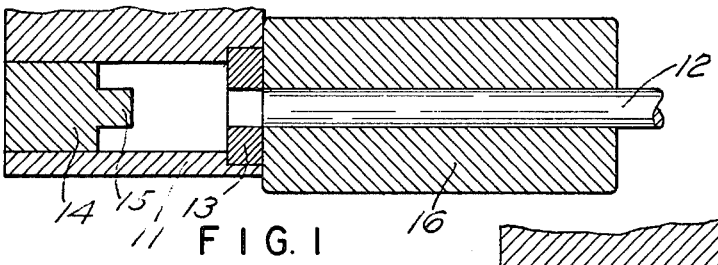
FIG. 1 is a fragmental sectional view of the supply of stock to the carrier arm tooling block.
Figure 2:
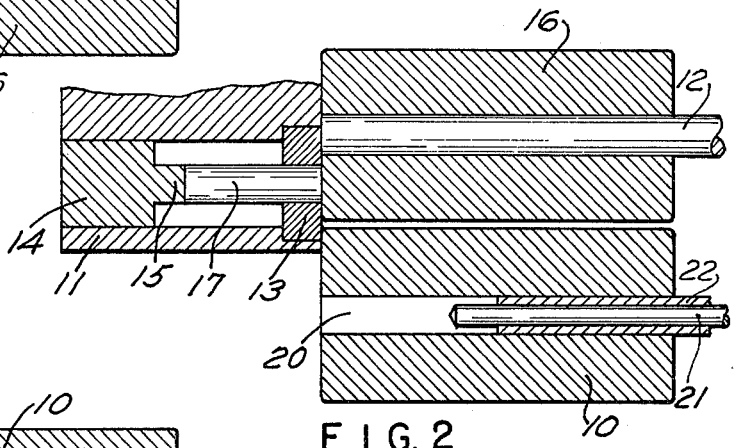
FIGS. 2 to 8 are fragmental section views of the fixed die and the work blank in various steps in the formation of the blank into a semi-tubular rivet.

Referring to FIG. 2, the fixed closed die is shown at 10 and the closed carrier or tooling block is shown at 11. The stock from which the blank is formed is designated 12 (FIG. 1) and is fed into an opening in the hardened cutoff bushing 13 in the carrier arm tooling block when the opening is in axial alignment with the stock 12 (FIG. 1). A movable pusher pin 14 limits the insertion of the stock 12 through the opening in the cutoff bushing 13 by reason of the reduced portion 15 at its inner end which acts as a stop. After the stock is fed into the stop 15, the carrier arm tooling block 11 moves laterally of the stock and its guide 16 so that the stock is cut off to form a blank 17 in the carrier arm tooling block as seen in FIG. 2.

Figure 3:
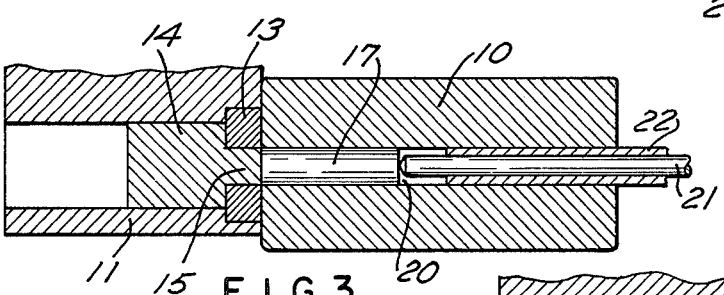

The knockout bushing 22 which surrounds extrusion pin 21 is retracted in fixed die 10 sufficient to receive the blank 17. The carrier arm tooling block 11 now advances laterally of the axis of the blank to align the blank with the opening 20 in the fixed die 10 (FIG. 3). The pusher pin 14 then moves to the right as shown in FIG. 3 to move the blank 17 into the opening 20 until flush with the face of die 10.

Figure 4:
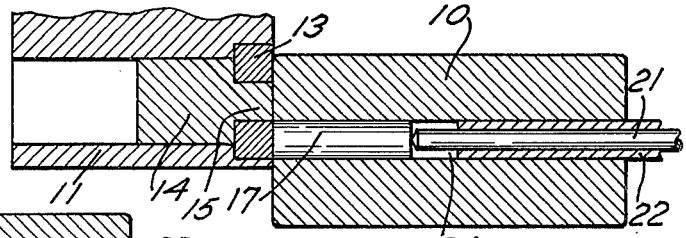

The next step is shown in FIG. 4 where the carrier arm tooling block 11 has retreated to move the hardened bushing 13 which surrounds the reduced portion of pusher pin 15 to a position opposite the blank 17 which has been placed in the die 10. This hardened bushing serves as an anvil engaging the end of the blank 17.

Figure 5:
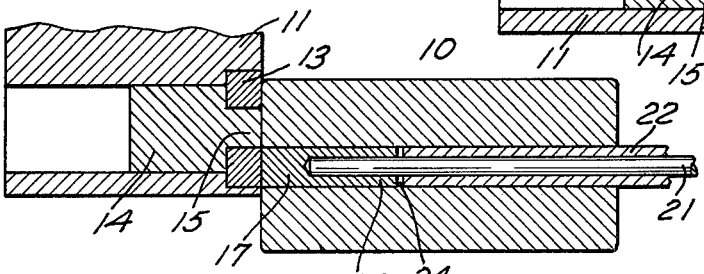

The next step is to advance the extrusion pin 21 into the blank 17 (FIG. 5) to provide a central opening or recess axially therein and cause the stock to flow into the space 24 surrounding the extrusion pin 21 and toward the knockout bushing 22 which does not extend to the end of the extrusion pin. All of this time the carrier arm tooling block has its hardened insert 13 acting as an anvil against which the end of the blank rests. The knockout bushing 22 leaves a small space 24 between the extruded material 23 and the knockout bushing 22 (FIG. 5).

Figure 6:
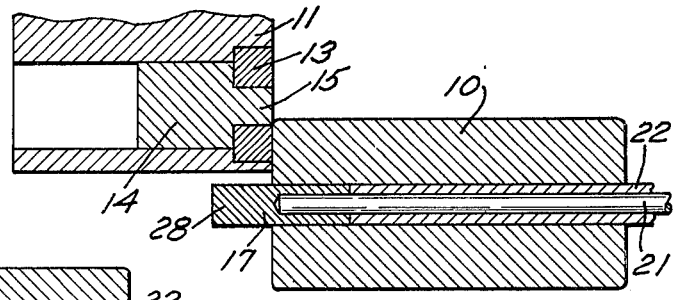

Upon completion of the extrusion, the carrier arm tooling block 11 further retreats as shown in FIG. 6 and the extrusion pin 21 and knockout bushing 22 advance the blank 17, which now has no anvil support at its end, out of the fixed die 10 an amount 28 necessary to form a head on the blank, this being governed by cam action. The extrusion pin 21 advances slightly less relative to the motion of the knockout bushing 22 so that the knockout bushing just contacts the extruded blank. Since the extrusion may be slightly uneven, the contact will be at the point where the length of the blank has increased most during extrusion.

After the operation of FIG. 6 the head forming hammer 30 strikes the portions 28 of the blank protruding beyond the face of die 10 so as to form a head 31 by causing a flow of the protruding metal into the shape of the head 31. At the same time the extruded blank is driven against the knockout bushing or sleeve 22 to square its butt end in a plane at right angles to its axis, the blank being backed up during this hammer operation by both the extrusion pin 21 and the knockout bushing or sleeve 22 which surrounds it.

Figure 8:
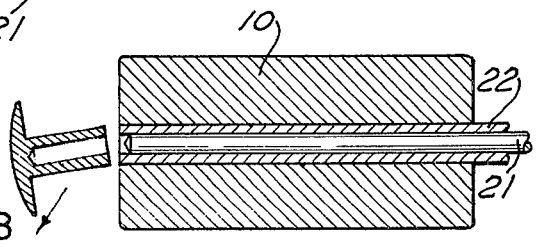

The next operation is shown in FIG. 8 where the hammer 30 has retracted and the extrusion pin 21 advances until slightly short of face of die 10 and the knockout bushing 22 about the extrusion pin 21 advances flush with face of die to eject the completed rivet with its head from the fixed die 10.

The Machine for Performing the Operations Above Outlined is as Follows

Figure 9:
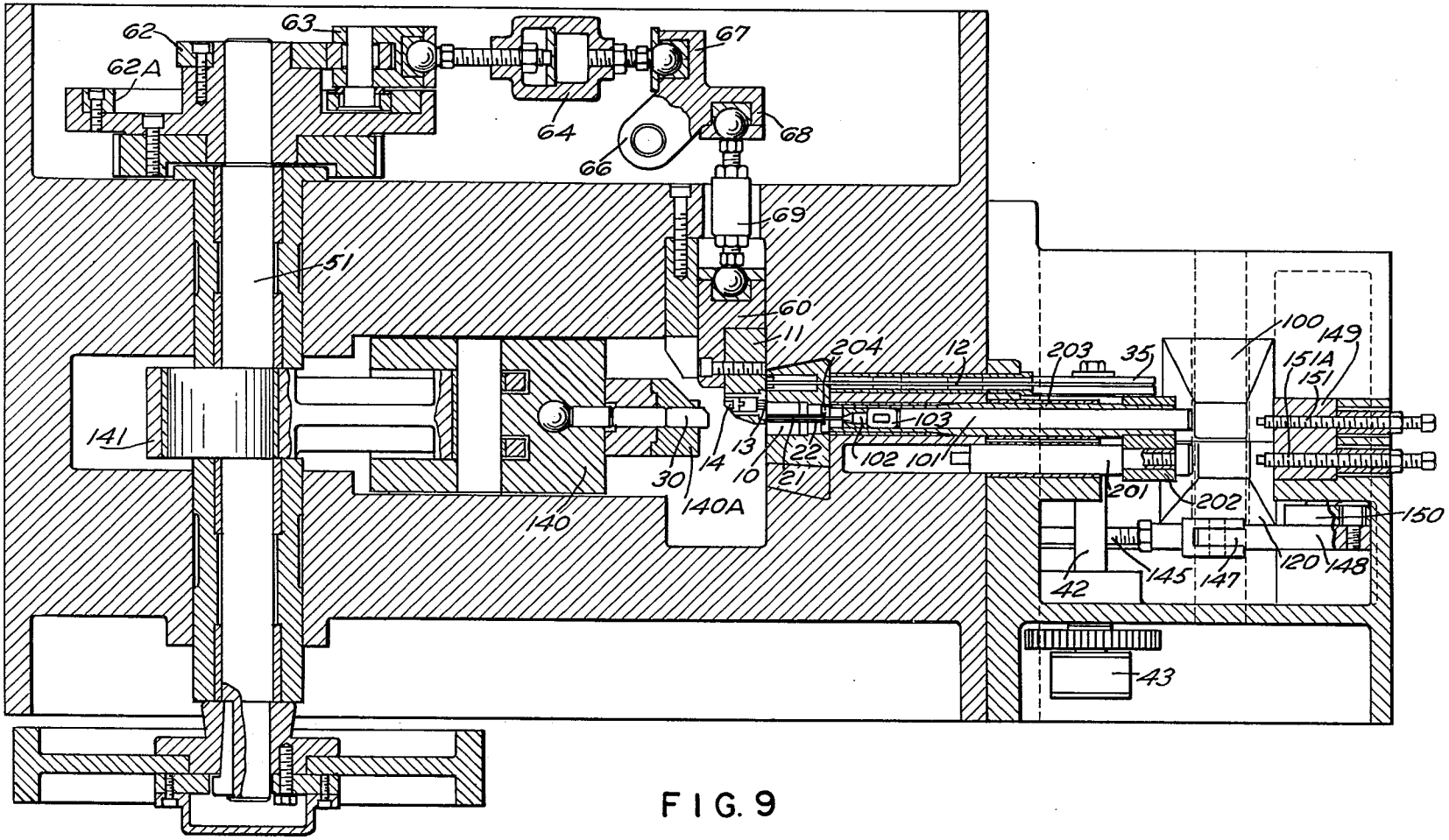
FIG. 9 is a sectional plan type view through the machine for forming the rivet at substantially the horizontal level of the fixed die.
Figure 10:
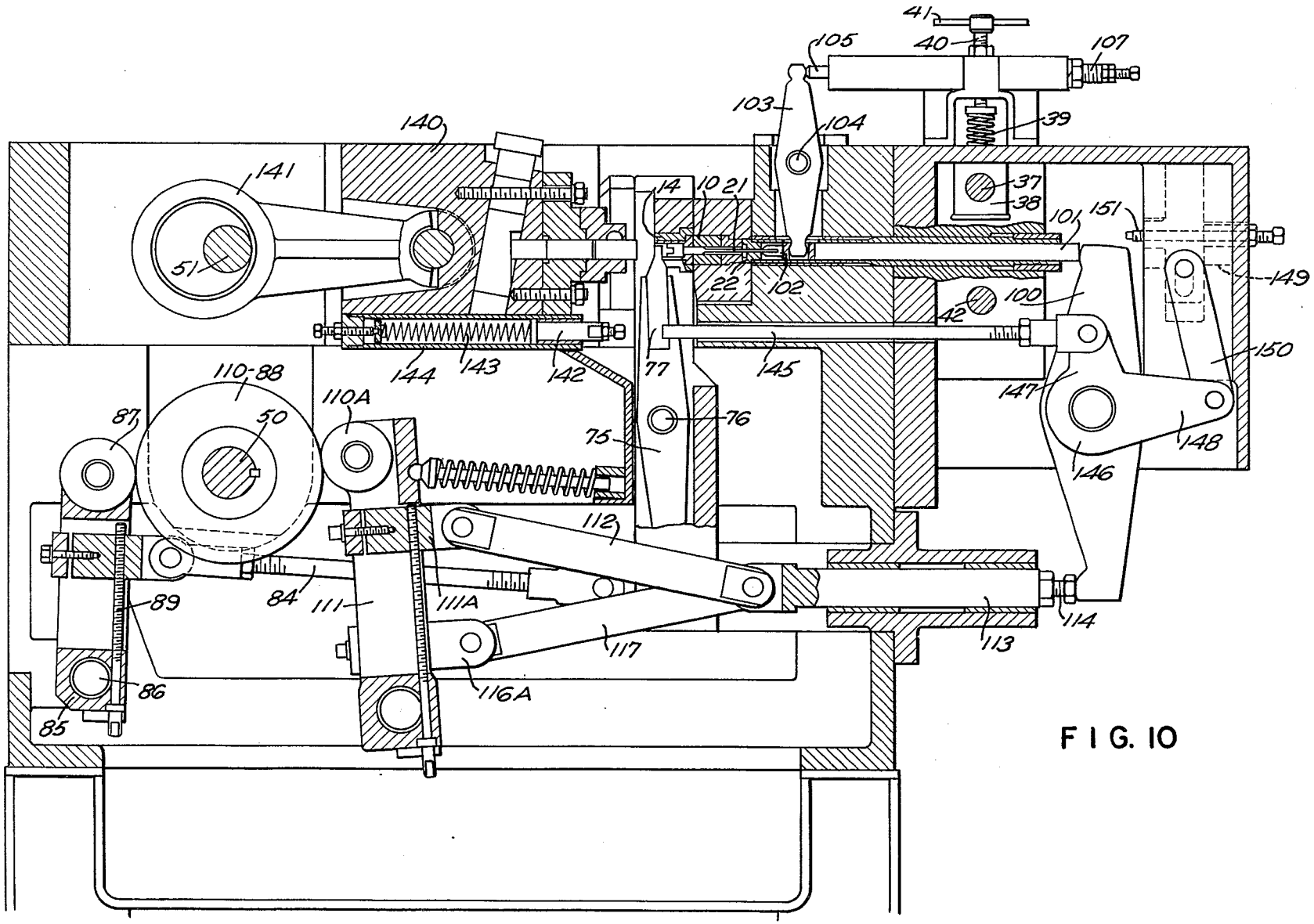
FIG. 10 is a vertical section of the machine through the fixed die.
Figure 11:
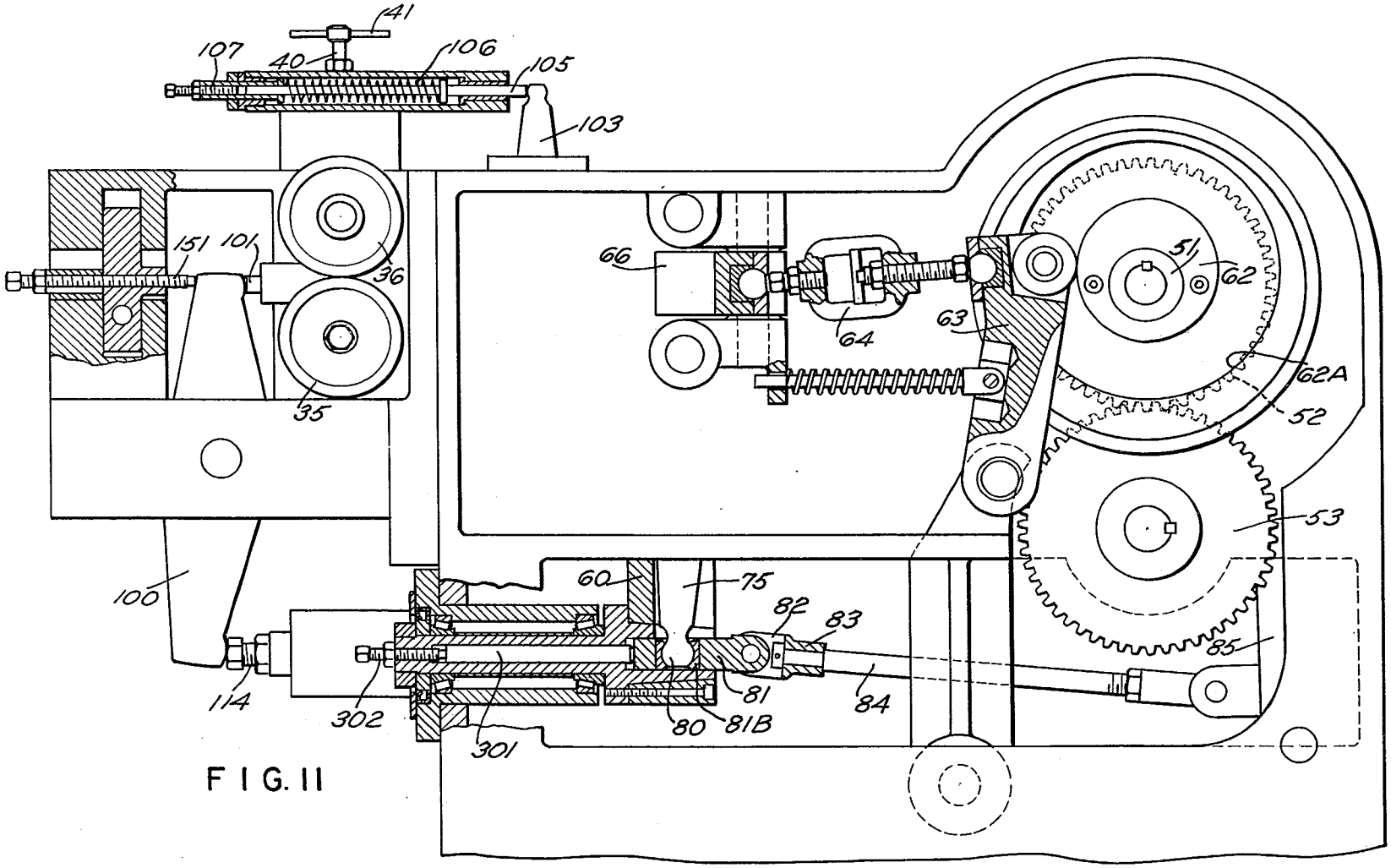
FIG. 11 is a side elevation with parts partly in section looking from the top side of FIG. 9.
Figure 12:
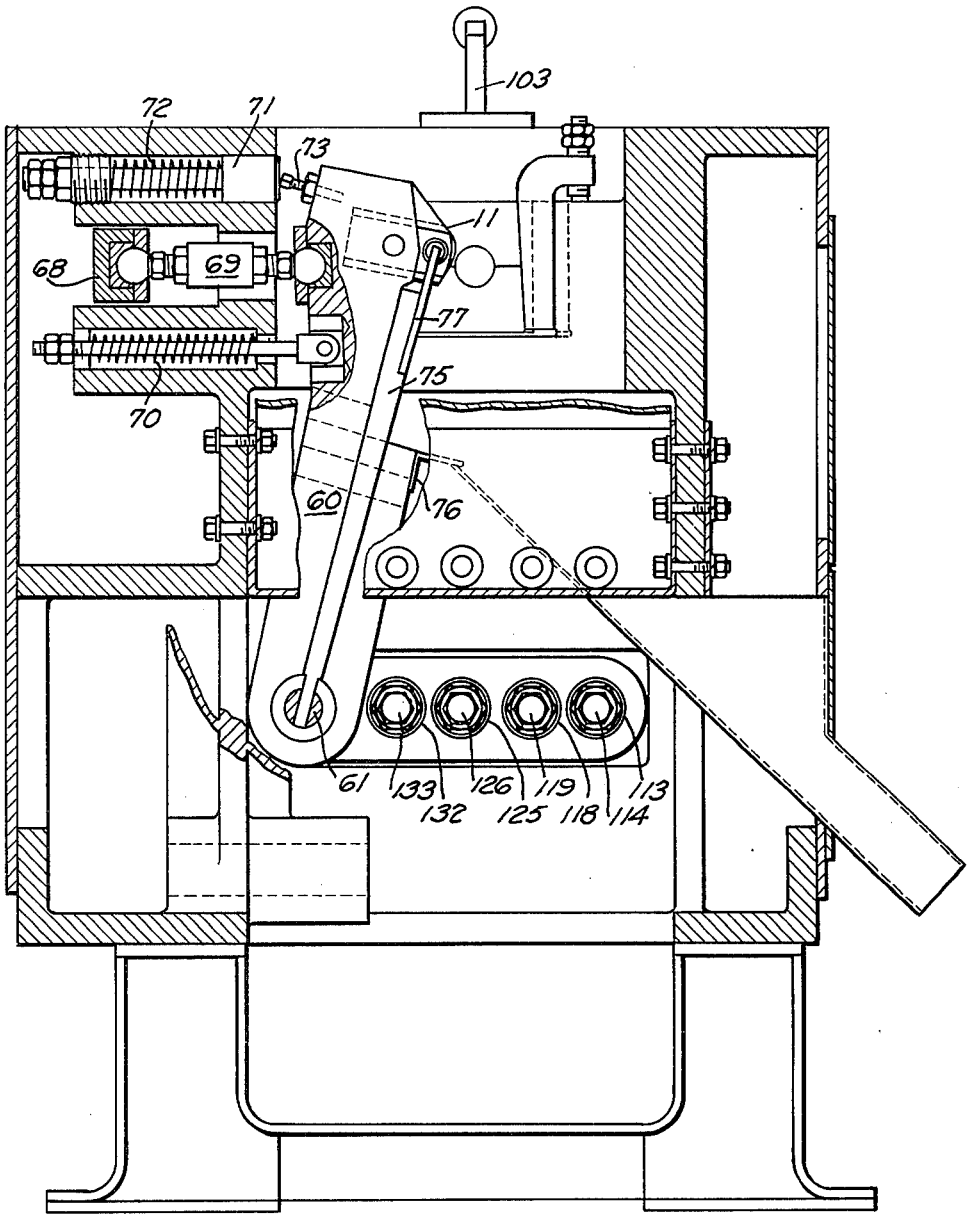
FIG. 12 is a sectional view adjacent the carrier arm.
Figure 13:
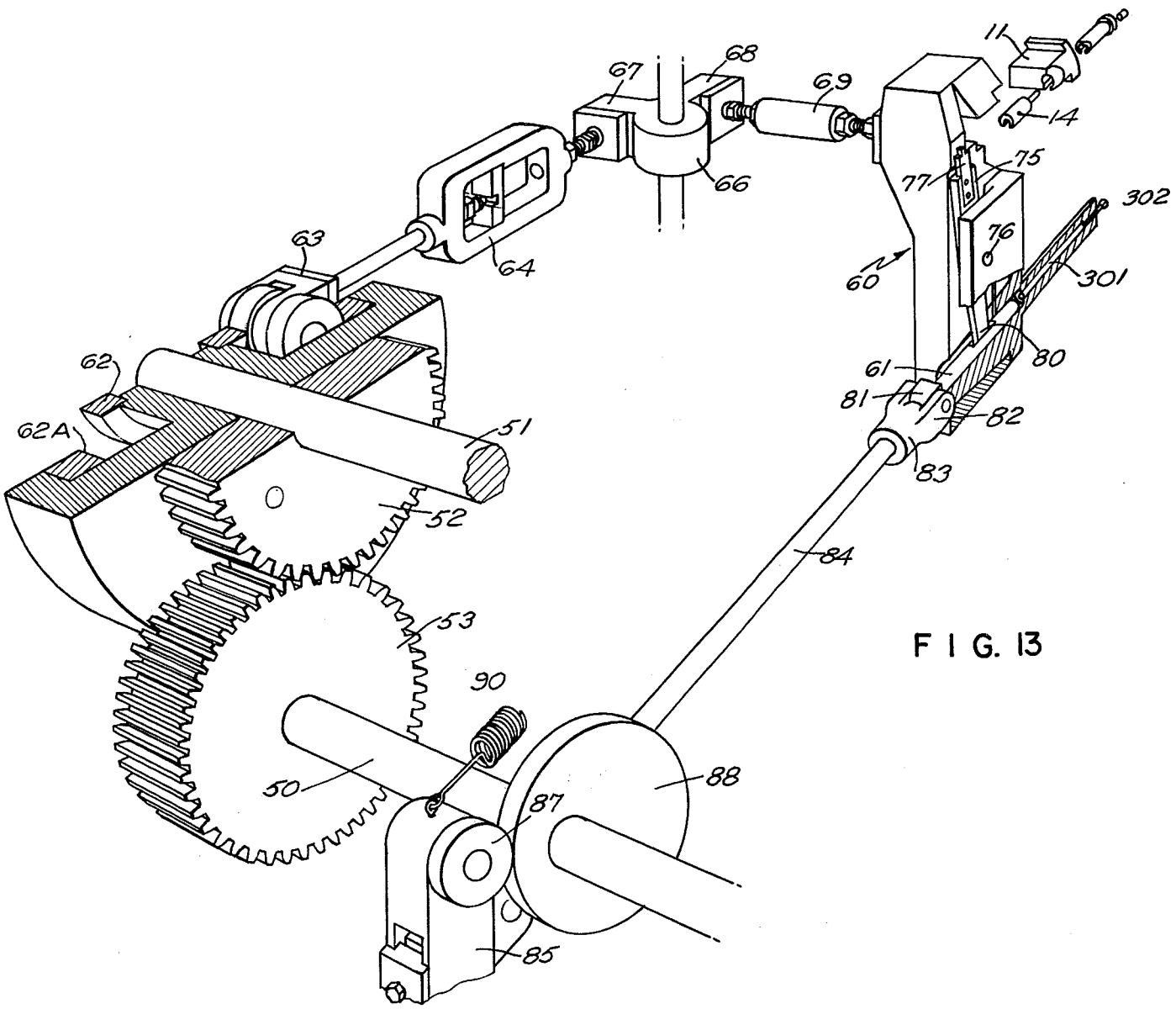
FIG. 13 is a perspective view partly in section of the carrier arm showing the operation of the parts movable therewith.
Figure 14:
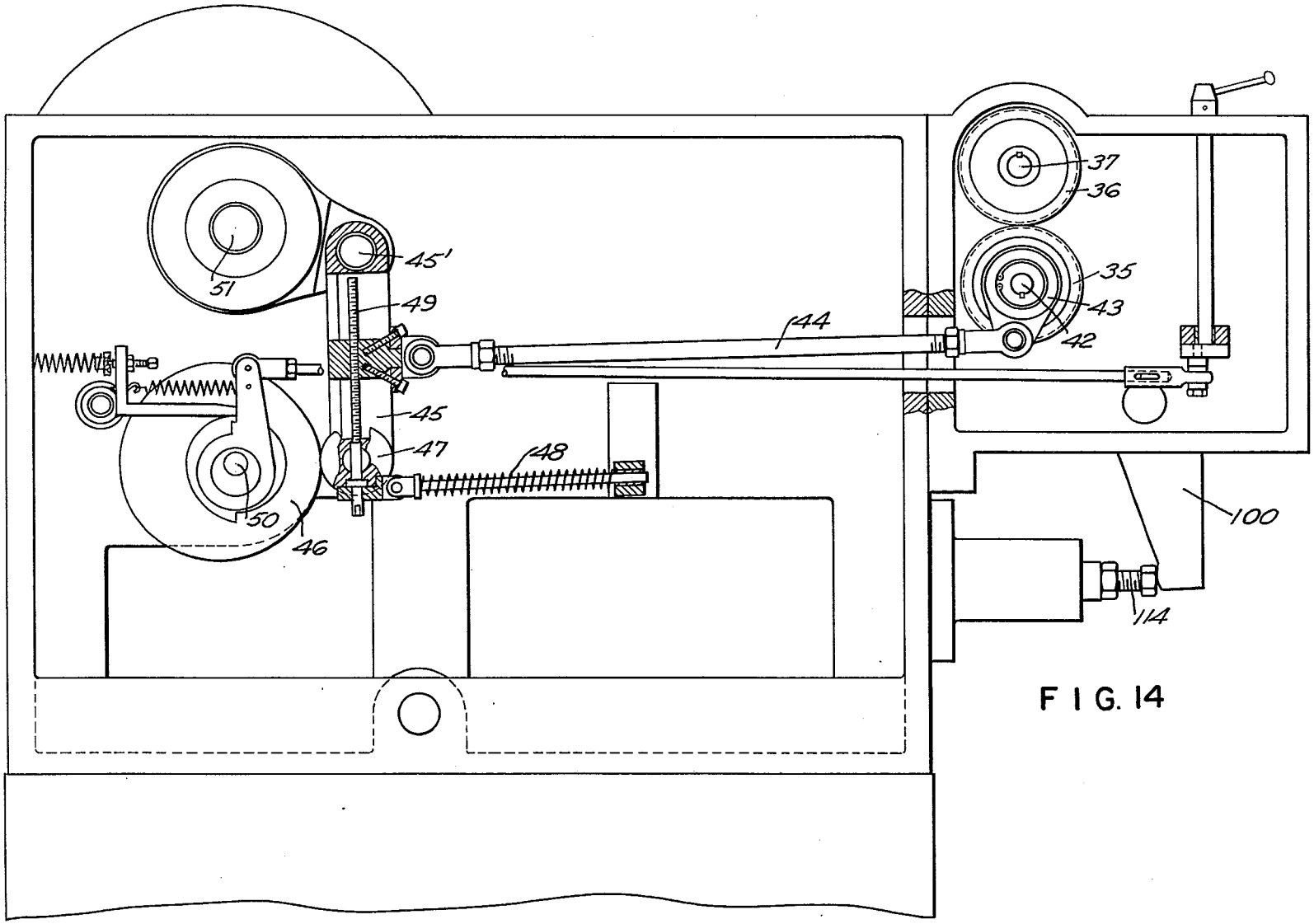
FIG. 14 is a vertical sectional view showing the supply stock feed rolls and their movement.

Referring to FIGS. 9 to 14, the supply of stock 12 is fed by feed rolls 35, 36. The shaft 37 (FIG. 10) of this upper roll 36 is mounted in a block 38 which is spring pressed as at 39 (FIG. 10) by an adjustable threaded member 40 having a handle 41 as shown in FIG. 10. The shaft 42 of the lower roll is mounted in a fixed block and a one-way clutch 43 (FIG. 14) rotates this roll 35 through the linking rod 44 by the rocking arm 45 about its pivot 45' actuated by cam 46 and roll follower 47. A spring 48 maintains the cam follower 47 against the cam 46. The length of the feed is adjusted by screw 49 to position the rod 44 various distances from pivot 45'. The cam 46 is on the cam shaft 50 on which there are many other cams and is driven from the main shaft 51 of the machine through one to one ratio spur gears 52 and 53 (FIGS. 11, 13).

The tooling block 11, as shown in FIGS. 9, 12, is mounted in the upper end of a cutoff arm 60 (see FIG. 12 and FIG. 13) which is pivoted on shaft 61. This cutoff arm 60 is actuated from the main drive shaft 51 by means of a conjugate cam 62, 62-A (see FIGS. 9 and 13) rocking an arm 63 which carries an adjustable connecting link 64. The link 64 operates a bell crank lever 66 which has arms 67 and 68, FIGS. 9, 13, and a connecting link 69, these links having spherical ends for rocking motion. The conjugate cam returns the arm 60 and is assisted in the last part of its return motion by a spring 70 (FIG. 12) to engage a stop 71 in its return motion which is urged by a spring 72 substantially stronger than the spring 70 into a relatively fixed position unless there should be some jam occur in the machine. An adjustment is provided as at 73 for the location of the stop of the arm 60. Arm 60 returns to align tooling block 11 with the supply of stock 12.

Also carried by this cutoff arm 60 is a pusher arm 75 (FIGS. 12, 13) pivoted on a shaft 76 in the arm 60 and which carries a finger 77 at its upper end to enter a recess in the pusher pin and sleeve 14. This arm 75 at its lower end as shown in FIG. 11 has a circular end 80 which is rockable in bearing insert 81-B the part 81 carried in a clevis 82 which has a shank end 83 rotatable about the rod 84 which is connected to an arm 85 (FIG. 10) rockable on a shaft 86 by a cam follower 87 from the cam 88 on cam shaft 50. Adjustments are provided for the throw as at 89 (FIG. 10) and the arm 85 holds cam follower 87 against its cam by spring 90 (FIG. 13). The position of pusher pin 14 with its reduced portion 15 when it acts as a stop is determined by the restraint of finger 77 (FIG. 13) mounted in arm 75, pushing against circular bearing 81B mounted in part 81 bearing against spacer shaft 301 which is backed up by adjustable screw 302. The position of adjustable screw 302 is used to determine the length of stock to be cut off.

From the above it will appear that the cutoff arm supplies the motion for the carrier arm tooling block as shown in FIGS. 1, 2, 3, 4, 5 and 6. After the carrier has retreated to the position shown in FIG. 4, the extrusion pin and the sleeve about it are operated. The carrier arm is stopped as shown in FIGS. 4 and 5, while the extrusion pin 21 operates, and thereafter the cutoff arm removes the tooling block 11 from further operation as shown in FIG. 6.

Figure 15:
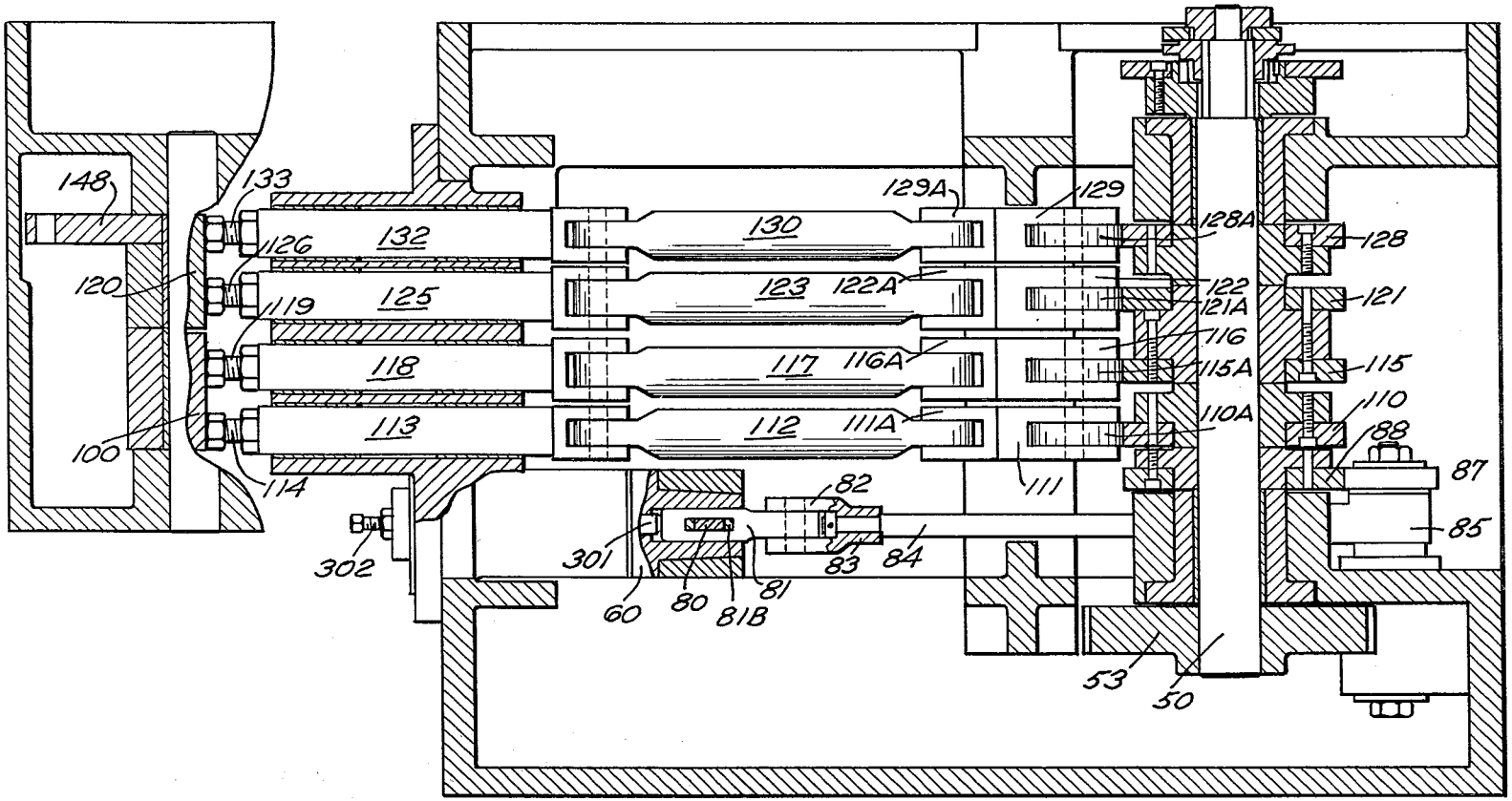
FIG. 15 is a horizontal sectional view of the cam shaft and the linkage operated by the cams.

An arm 100 (see FIG. 10) acts upon the rod 101 to push the holder 102 for the extrusion pin 21 to force it into the blank in the fixed die 10. The rod 101 which pushes the holder 102 receives a rocking lever 103 pivoted as at 104 and engaged by a pin 105 pressed by a spring 106 (see also FIG. 11) adjustable as at 107 to properly tension the spring 106. This spring 106 pushes the rod 101 against the lever 100 which is controlled by the cam action. Two cams are used to operate upon the lever 100. A first cam 110 (FIG. 15) urges through roll 110A in lever 111 through vertically adjustable clevis 111A and its connecting rod 112 which through presser 113 adjustable as at 114 slowly swings the lever 100 to move the extrusion pin into the blank (FIG. 5). Once the extrusion is complete and the carrier has cleared the mouth of the face of the die (FIG. 6) the extruded blank is now unrestrained with respect to axial forward motion out of the die. However, the blank has been firmly expanded into die by the forming action of the extrusion pin. The blank must be moved forward before the head forming hammer 30 strikes the blank in order to provide the volume of stock necessary to form the head. Because of the high force required to initiate the movement of the tightly expanded blank at the same time the train of mechanisms driven by cam 110 is still under compression from the extrusion operation which implies there is no slack in the system a gentle 1/32" rise in the extrusion cam profile following the dwell required for arm 60 to clear the mouth of the fixed die 10 results in a smooth initial push to urge the blank 17 forward as shown in FIG. 6. However, a fixed rise on cam 110 cannot be used to provide the complete forward motion required since the amount of material necessary to form the head varies from rivet to rivet. An independent adjustment is required, and the adjustment provided by clevis 111A must be used to regulate the amount of extrusion. Hence the remainder of the required motion is provided by cam 115. Cam 115 (FIG. 15) operates through roll 115A in lever 116 and vertically adjustable clevis 116A and connecting rod 117 and pusher 118 with its adjustment 119 to further move lever 100 whereupon the extrusion pin 21 moves the blank out of the die an exact amount corresponding to that length of blank necessary to form the head. It is the function of adjustments 111A with 114 and 116A with 119 to obtain exactly any desired combination of extrusion and head displacement motions according to the various dimensions required when making different rivets. This slow action overcomes pin inertia and reduces the force required due to the phenomena of stick slip friction for the accelerating action of cam 115. A second arm 120 similarly acts upon the sleeve or knockout bushing 22 which embraces the extrusion pin; that is, its motions are controlled by two cams one of which is designated 121 and operates through roll 121A in arm 122, clevis 122A, link 123, pusher 125 and adjustment 126 to move the arm 120 a certain amount forward through shaft 201 (FIG. 9) attached to connecting block 202, sleeve 203 attached to block 202, knockout bushing head 204 and follow the extrusion pin in moving the blank part way out of the fixed die in order to form the head. For the same reasons explained with respect to a second rise on cam 110, there is a slight second rise on cam 121 to begin the knockout motion of arm 120; however, the major portion of this movement is provided by cam 128 with its independent adjustment. The cam 128 acts through roll 128A in arm 129, adjustable clevis 129A, connecting link 130, pusher 132 and adjustment 133 on the arm 120 to eject the rivet through the knockout bushing 22 after it is completed and headed.

Figure 7:
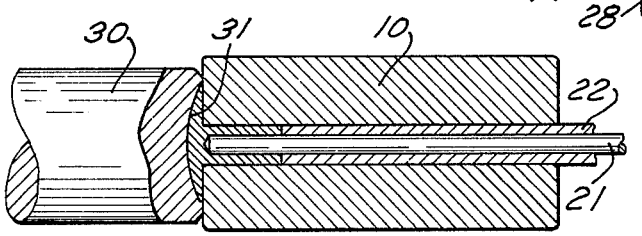

After the extruding operation and the advancing of the blank to protrude it as at 28 beyond the face of fixed die 10 as shown in FIG. 6, a heading hammer 30 is actuated. This hammer is mounted in a punch block 140A, fixed to ram 140 (see FIG. 9) which is forced into operation by eccentric 141 mounted on the main shaft 51 and in one blow causes the protruding part 28 of FIG. 6 to be flowed into the form of head 31 as shown in FIG. 7. The cams which operate the knockout bushing 22 and the extruding pin 21 back up the rivet at the time of this blow and further back up is provided (see FIGS. 9 and 10) by adjustable stops 151 and 151A. These stops are up out of the way in FIGS. 1 through 5 and are lowered into position for FIG. 7 by pin 142 (FIG. 10) pressed by spring 143, and operating in tube 144 mounted in ram 140 engaging the rod 145 which acts through bell crank lever 146 having arms 147 and 148 to draw down the block 149 acting through link 150 to cause its adjustable pins 151, 151A (FIG. 9) to back up the lever 100 which backs up the extrusion pin through rod 101 and its adjustable pin 151A to back up lever 120 which backs up the knockout bushings thru shaft 201 (FIG. 9).

In one rotation of the main shaft the different movements occur as shown in the timing diagram (FIG. 16) and the relation of the cam driven motions to this one complete revolution of the main shaft are laid out by degrees which the main shaft rotates as the cams operate and it shows a timing which is allotted to each motion.

Figure 16:
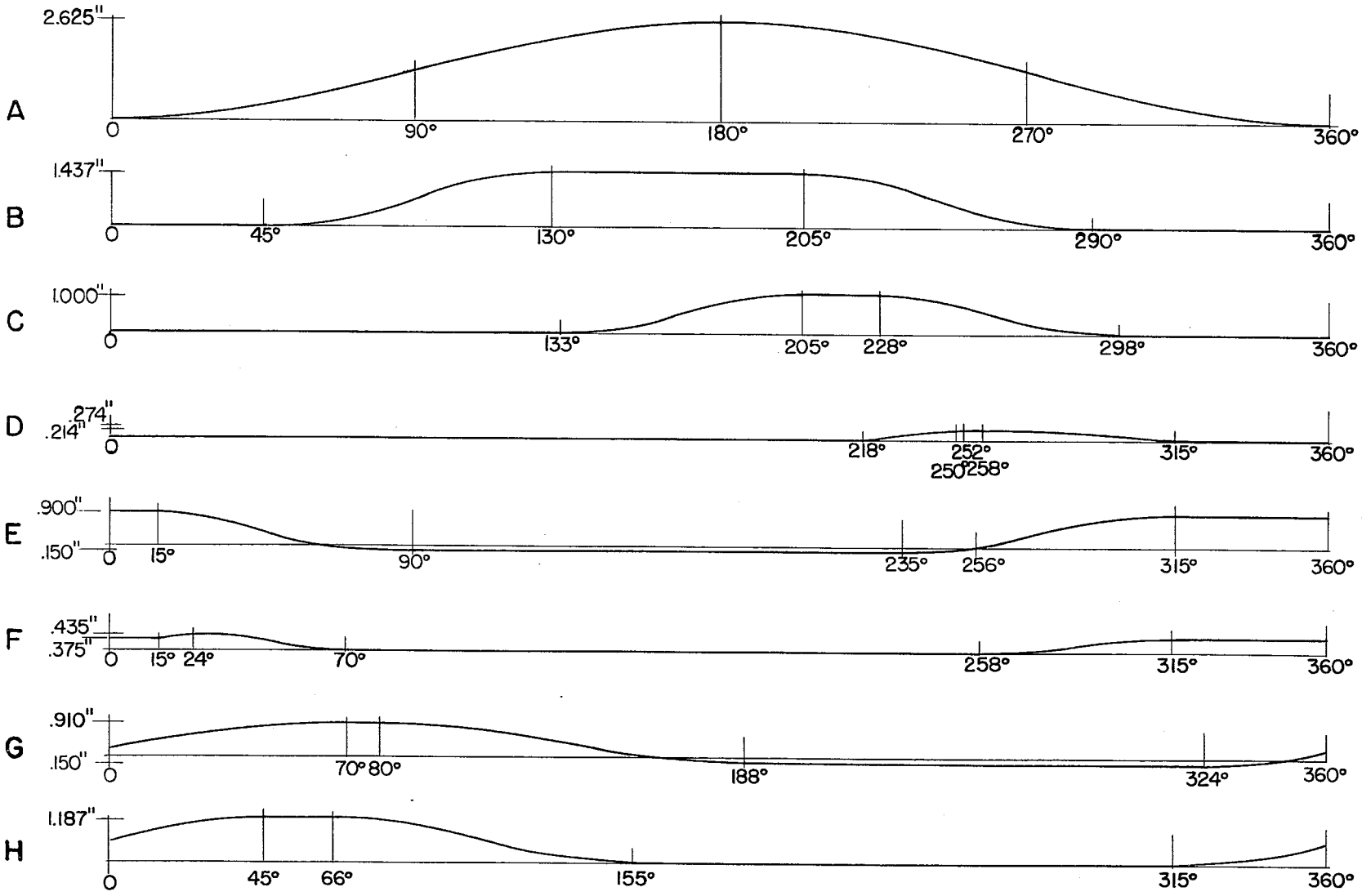
FIG. 16 is a diagrammatic view of the timing of the various movements of the parts.

The diagramming FIG. 16 at A illustrates the movement of a hammer from the hitting position 0 throughout a complete revolution of the main shaft which corresponds to the complete cycle for the production of one part back to hitting position at 360° which is practically the withdrawing cycle of the hammer. In B, which is the cutoff carrier arm movement, the arm is initially in a position where the moving cutoff bushing is aligned with the fixed cutoff bushing and then the arm starts in at just after 45° and comes to rest lined up with the fixed die from 130° to 205° at which time a withdrawal movement occurs to just short of 290°. In C the blank started to be pushed in to the fixed die just after 133° is all the way in from 205° to 228° and then the motion of the pusher finger reverses. In D the extrusion is compared with the anvil against which the blank rests and this anvil takes its blocking position at 218°. After an initial extrusion movement from 218° to 250°, the cam dwells until 252° while the carrier clears the fixed die from 250° to 252° and the extrusion cam against continues its movement until 258° and the blank receives an initial urging out of the fixed die in order to provide material for the formation of the head. At E the blank is pushed the rest of the way out via the extrusion pin by a separate cam. This cam starts its stroke at 235° and at some point between 235° and 315° picks up and completes the motion initiated at 252° shown in part D. There is no further movement from 315° to 360° and up to 15° after the start of the cycle during which time the head of the rivet is formed. The stroke of the cam is then returned as shown thereafter. In F the knockout bushing must follow the motion of the extrusion pin but it also initiates the knockout movement at 15° and operates through lever 100 falling thereafter to return to rest about 70° and then again commences operation at 258° through the remainder of the cycle and first part of the next cycle. In G the pickup by a separate cam to complete the movement of the knockout bushing starts in just before the 360° and carries all through 0° to 70° dwells until 80° and then is returned. In H the feed cam for the new piece of stock starts in just after 315° through the 360° and the next cycle through 45°. It dwells until 66° and then is withdrawn by 155° of the cycle.

The use of a laterally introduced blocking element for providing an anvil against which the sheared blank is forced by extrusion pressure means that the sheared end of the blank which will subsequently be upset to form the head can be worked somewhat in order to achieve some of the benefits normally pertaining only to two blow designs. In particular an oil relief hole can be located in the side blocking element, permitting oil on the upset end of the sheared blank to escape during the extrusion operation. Without this feature it is very difficult to produce an unblemished head on a semi-tubular rivet. The difficulty of removing the oil and producing a blemish free head has been a serious complaint of users of machines produced according to the design disclosed in U.S. Pat. No. 3,720,968.

Since the laterally introduced blocking element can be in movement during the extrusion operation, it is even possible to work the sheared end of the blank by extruding against various configurations of shallow cavities in the above mentioned element and thus achieve a degree of burnishing of the sheared edge prior to the upsetting operation. This permits forming a more perfect head than is ever possible with an ordinary single heading blow design.

The use of a laterally introduced blocking element which is operative during the advance of a pin located in a fixed die and working from the opposite end is novel, it is not intended to limit the scope of the claim to cold headers of the single die single blow configuration. Such a lateral mechanical element can be useful whenever it is desired to work the end or ends of a sheared blank without the intervention of punches mounted on the heading ram. In particular, a lateral element could be useful in conjunction with an extruding two die configuration or a single die two blow cold header configuration for forming extruded rivets with large heads. It would also be useful for simply preforming or coining the sheared blank prior to upset in a single or multiple die setup.

Under normal production conditions machines for the production of semi-tubular rivets are frequently called upon to produce a variety of rivets with short sheared blank lengths, often shorter than 5/16". At the present stage of the art this is a problematic procedure. The present invention embodies a separate mechanism for seating the sheared blank into the heading die which does not depend upon the motion of the heading slide nor upon a heading punch or hammer contacting the sheared blank to seat it in the heading die.

Hence there is no difficulty involved in the production of short rivets, and the level of skill required by the setup mechanic is substantially reduced. The time required to readjust the cold header when changing the machine to produce a different length rivet is greatly reduced, and no change of tooling or machine parts is involved. In fact the design is unique in that throughout the range of capacity of the machine, no changeover from one combination of head sizes, shank lengths, and hole depths to another requires the timing or synchronization of any one movement with any other. All movements are independent and their timing is fixed by machine construction regardless of the variables of rivet dimensions. The only types of adjustment required by the setup mechanic correspond to adjustments of clearance or amount of movement observed with respect to each mechanism. Hence setup mechanics can be easily trained in the operation of the header and less highly experienced mechanics are required to operate it. The design lends itself especially to the production of short rivets impractical to produce by other means.

This invention uses the preferred type of cutoff tooling known to the art, namely a closed bushing. The quality of the sheared blank is superior to that obtained through the use of open cutoff tools, and the cost of the closed cutoff bushing is substantially less than that of the alternative known as the open cutoff knife. Nevertheless due to the novel way in which the cutoff bushing is mounted in relation to a pusher finger, no transfer fingers are necessary in this design.

The total list of interchangeable tooling is comprised of 1. feed rolls, 2. a fixed cutoff bushing, 3. a moving cutoff bushing, 4. a pusher pin, 5. a single fixed die, 6. a single heading punch, 7. a single knockout bushing and 8. an extrusion pin. All of these elements can be changed individually or together in order to produce different configurations of rivets.

The knockout bushing and extrusion pin derive their movement from a novel configuration and combination of cams which permit the production of shank ends or butt ends which are unusually square. The variation of shank length is unusually small due to the configuration, combination and form of the above mentioned cams. In the interest of dedicating a reduced portion of the cycle of the heading machine to the blank feeding operation, and thereby providing increased time for other operations during the machine cycle, which consequently permits increased machine speeds, a novel cam driven mechanism is provided for feeding the rivet blank in an improved manner and in less than 180° of the complete 360° of the machine cycle if this is desired.

We claim:

1. In a rivet forming machine, a fixed closed die having an axial opening therein with an entrance mouth, means movable laterally of said axial opening for introducing a cylindrical blank axially into the mouth of said die opening, said blank having opposite ends, said means comprising a closed carrier for a blank and an axially aligned pusher pin moving together laterally with the closed carrier, first to align the blank in the carrier and pusher pin with said die opening and then for movement of the pusher pin by cam means to place the blank into the mouth of this die opening and thereafter to laterally retract said carrier relative to the axis of said opening to position the carrier to close the mouth of the opening and act as an anvil means at one end of the blank after the blank is inserted in the fixed die, an extrusion pin, means to advance the pin axially in the opening of the fixed die toward the mouth of the opening to engage the blank and force it against said anvil means to form an axial recess therein at the other end of the blank.

2. In a rivet machine as in claim 1 wherein the laterally movable means at a point in its movement stops and receives a length of stock and then advances to sever the blank from said length and further advances to present it in alignment with said die mouth, and transfer the blank into a closed die by cam means.

3. In a rivet machine as in claim 2 wherein the laterally movable means then retreats to close the mouth of the closed die opening.

4. In a rivet machine as in claim 3 wherein the laterally movable means carries a bushing to receive the cutoff length of stock and the bushing closes the die opening.

5. In a rivet machine as in claim 1 wherein the means to advance the extrusion pin comprises a first cam to achieve an extrusion movement and then again to slowly advance the pin a short distance and a second cam to further advance the already advancing pin at an increased acceleration and variable distance whereby the first cam overcomes the inertia of the pin before the second cam acts.

6. In a rivet machine as in claim 1 wherein the extrusion pin is located in a sleeve, and means to advance the sleeve to engage the work at the end in which the recess is formed and eject the work from the fixed die.

7. In a rivet machine as in claim 6 wherein the means to advance the sleeve to engage the end of the work in which the recess is formed comprises a first cam to start the sleeve and a second cam to further advance with an adjustable motion the already advancing sleeve.

8. In a rivet forming machine having an operating cycle comprising a single crank rotation of 360° for each completed work piece, a single fixed closed die having an axial opening therein with an entrance mouth, means for introducing a cylindrical blank axially into the mouth of said die opening, means for blocking off the mouth of said die opening consisting of a laterally introduced anvil, an extrusion pin, cam means to advance the pin axially of the opening toward the mouth of the opening after insertion of the blank to engage the blank supported against said anvil to form an axial recess therein during a part of the machine cycle, means to strike and form a head by a crank and Pitman derived single stroke motion for each 360° machine cycle on the end of said blank opposite the end with the axial recess during a subsequent part of the same machine cycle.

9. In a rivet forming machine as in claim 1 wherein the means to form a head on the blank is independent of the means to advance the cutoff blank into the heading die and is subsequently to the means to extrude an axial recess in the blank.

10. In a rivet forming machine, a heading die having an axial opening with an entrance mouth, means for feeding a length of stock into a closed carrier, means for moving said carrier to cut off a blank from said length of stock and advancing the carrier and blank to said heading die, means independent of said carrier advancing means to introduce said blank into said heading die, means to retract said carrier means to close off the axial opening mouth of said die by said carrier thereby providing an anvil, an extrusion pin, cam means to force said extrusion pin toward said mouth against said blank while the mouth is closed and an anvil is provided for the blank to form an axial recess in the blank, means to further retract said carrier means from the mouth of the heading die, means to advance the extruded blank out of the heading die sufficient to leave material to form a head, means to form a head on the advanced blank including a heading punch and means to knock the headed rivet out of the heading die.

11. The rivet forming machine of claim 10 wherein the heading means is independent of and subsequent to the means forcing the extrusion pin.

12. A method of forming a hollow metal article which comprises the steps of: inserting a solid metal blank into a carrier having an opening in a bushing, aligning by laterally moving said carrier opening with a cavity in a closed single fixed die, introducing a blank into said die which die snugly but slidably receives the blank, then laterally retracting said carrier relative to said die face to cause a portion thereof to block said cavity into said die and act as an anvil for one end of the blank, forcing an extruding punch axially of the die opening toward said anvil into the other end of the blank at a time in the operating cycle different from the step of introducing the blank into the die and prior to the forming of a head on the blank thereby form an axial recess in said blank.

13. The method of claim 12 wherein further steps are removing the carrier from blocking position, moving the blocked end of the blank partly out of the die cavity by further advancing the extruding punch, and then contacting the blank at the end to be formed into the head only once during the operation cycle by a tool having a reciprocating motion parallel to the movement of the extruding punch while holding said punch relatively stationary to upset and radially expand said protruding blank into a head.

14. The method of claim 13 wherein the ejection from the fixed closed die is by means of a sleeve telescoping said extruding punch.

* * * * *